United States Patent [19]

Glover

[11] 4,223,816

[45] Sep. 23, 1980

[54] HOSIERY CUFF FORMING APPARATUS

[75] Inventor: Clarence J. Glover, Denton, N.C.

[73] Assignee: Surratt Hosiery Mill, Inc., Denton, N.C.

[21] Appl. No.: 9,169

[22] Filed: Feb. 5, 1979

[51] Int. Cl.[3] ..... A41H 33/00

[52] U.S. Cl. ..... 223/37; 223/40

[58] Field of Search ..... 223/37, 39, 40

[56] References Cited

U.S. PATENT DOCUMENTS

| | | | |
|---|---|---|---|
| 1,000,289 | 8/1911 | Patterson | 223/37 |
| 1,001,983 | 8/1911 | Roberts | 223/37 |
| 1,101,522 | 6/1914 | Chipman | 223/37 |
| 2,480,207 | 8/1949 | Adelman | 223/40 |
| 2,849,167 | 8/1958 | Walser | 223/37 |
| 4,010,877 | 3/1977 | Hayes et al. | 223/37 |

FOREIGN PATENT DOCUMENTS

| | | | |
|---|---|---|---|
| 1345376 | 1/1974 | United Kingdom | 223/39 |

*Primary Examiner*—Louis Rimrodt

*Attorney, Agent, or Firm*—Bell, Seltzer, Park & Gibson

[57] ABSTRACT

The present apparatus automatically forms the desired length of folded cuff on hosiery articles and the cuffed hosiery articles are automatically removed from the apparatus. The operator is only required to successively position hosiery articles on tubular members (T-1, T-2 and T-3) as they are successively moved in a step-by-step manner by a turret (10) to a loading station, a cuff folding station, and a hosiery stripping station. The operator draws a hosiery article over the tubular member (T-1) at the loading station with the closed toe end of the hosiery article covering the open free end of the tubular member. The tubular member is then moved to the folding station where a plunger (30) moves the closed toe end of the hosiery article inwardly of the tubular member leaving a folded cuff on the outside of the tubular member (T-2). The tubular member is then moved to the stripping station where gripper means (13) removes the hosiery article with the folded cuff from the tubular member (T-3) and releases the same into a convenient collection receptacle.

6 Claims, 7 Drawing Figures

H
T-2
40
41
42
43

13
51
52
71
72
55
63
64
75
62
15
35
32
31
30
4
T-3
77
78
10
T-1
H
T-2
11
17
16

HOSIERY CUFF FORMING APPARATUS

FIELD OF THE INVENTION

This invention relates generally to an apparatus for forming a folded cuff on a hosiery article and more particularly to such an apparatus wherein the hosiery article is positioned on a tubular member, the cuff is folded and the cuffed hosiery article is automatically removed from the tubular member.

BACKGROUND OF THE INVENTION

Various types of devices have been proposed for forming a cuff on hosiery articles. Examples of these known prior types of cuff forming devices are disclosed in U.S. Pat. No. 1,000,289; 1,101,522; and 2,849,167. The hosiery article must be accurately placed on each of these devices to insure that the proper length of cuff is formed and the operator is required to manually remove the hosiery article from the cuff forming device. Since the hosiery article must be accurately positioned on the device by the operator, the rate at which the hosiery articles can be cuffed is somewhat limited and the cuffed hosiery article must be carefully removed from the device so that the position of the turned cuff is not changed or disturbed.

SUMMARY OF THE INVENTION

With the foregoing in mind, it is an object of the present invention to provide a cuff forming apparatus which permits an operator to accurately position successive hosiery articles on the apparatus in a rapid manner so that a folded cuff is automatically formed and the cuff hosiery article is automatically removed from the apparatus while the position of the folded cuff is not disturbed.

In accordance with the present invention, the apparatus includes a plurality of tubular members each including an open free end over which the open end of the hosiery article is adapted to be drawn so that the closed toe end of the hosiery article covers the open free end of the tubular member. A turret is supported for step-by-step rotation and supports the other ends of the tubular members in equally spaced positions. The turret successively moves the tubular members to a loading station, a folding station, and a stripping station.

A supply of hosiery articles in everted or wrong-side-out condition is provided adjacent the loading station where they are easily accessible to the operator for successively drawing a hosiery article over each of the tubular members as they are successively moved to the loading station. With the closed toe end of the hosiery article covering the open free end of the tubular member, the tubular member is then moved to the folding station where a plunger is reciprocated inwardly a predetermined distance into the open free end of the tubular member so that the closed toe end of the hosiery article is moved inwardly of the tubular member, leaving a folded cuff on the outside of and overlying and encircling a portion of the tubular member adjacent the open free end and the portion of the hosiery article positioned on the inside of the tubular member.

The tubular member is then moved to the stripping station where stripper means is supported for reciprocating movement adjacent the open free end. The stripper means is moved inwardly to grip the hosiery article with the folded cuff on the outside of the tubular member and the remainder of the hosiery article on the inside. The stripper means is then moved outwardly to withdraw the cuffed hosiery article from the tubular member and release the same into a convenient collection receptacle.

The step-by-step rotation of the turret and the tubular members is controlled by the operator and the operator is only required to draw a hosiery article over the open end of the tubular member with the closed toe end of the hosiery article covering the open free end thereof each time a tubular member is moved to the loading station. Thereafter, the cuff is formed automatically at the turning station and then the cuff hosiery article is automatically removed from the tubular member at the stripping station. Thus, folded cuffs can be formed on hosiery articles with the apparatus of the present invention in an accurate manner and at a rapid and economical rate.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
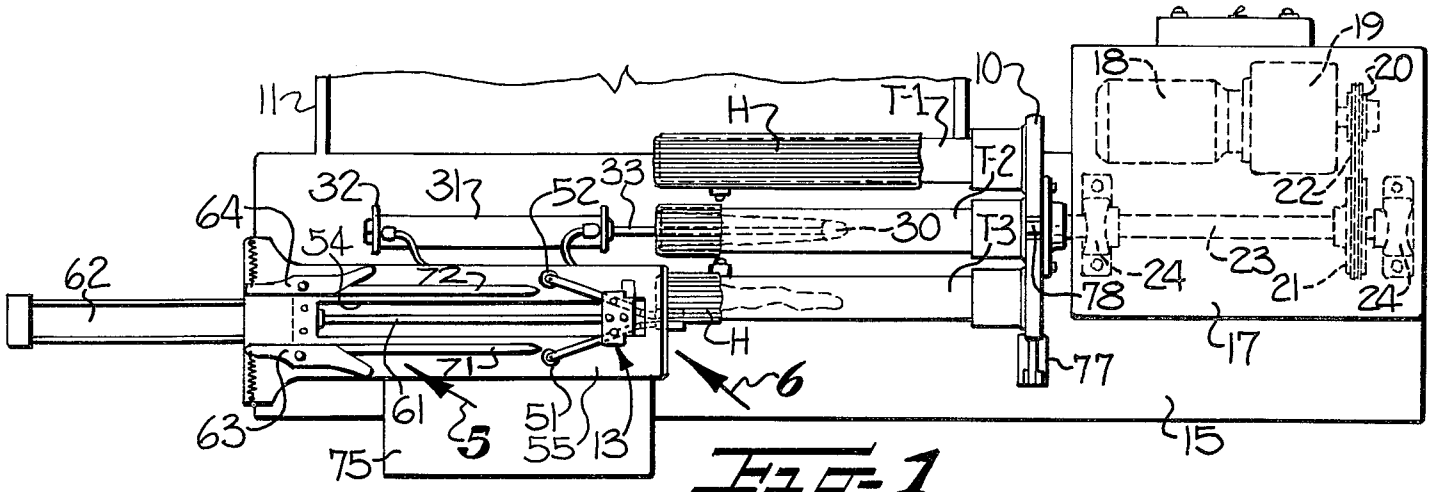
FIG. 1 is a plan view of the cuff forming apparatus of the present invention.

The cuff forming apparatus of the present invention is provided with a plurality of tubular members, and in the embodiment illustrated three tubular members, indicated at T-1, T-2 and T-3, are provided. The tubular members are each provided with an open free end over which the open end of a hosiery article H is adapted to be drawn so that the closed toe end of the hosiery article covers the open free end of the tubular member, in the manner illustrated in FIG. 3 with the hosiery article H on the tubular member T-1.

The other or inner ends of the tubular members are each supported in equally spaced positions on a turret 10 which is supported for step-by-step rotation in a manner to be presently described. As the turret member 10 is rotated in a step-by-step manner, each of the tubular members is successively moved into alignment with a loading station, as illustrated by the tubular member T-1 in FIg. 3. A conveniently located bin or receptacle 11 is provided to contain a supply of hosiery articles to be cuffed. The bin or container 11 is conveniently located adjacent the loading station with the hosiery articles in everted or wrong-side-out condition being positioned so that they can be easily and quickly removed from the bin 11 and placed on a tubular member when it is moved to the loading station.

Figures 3, 4:
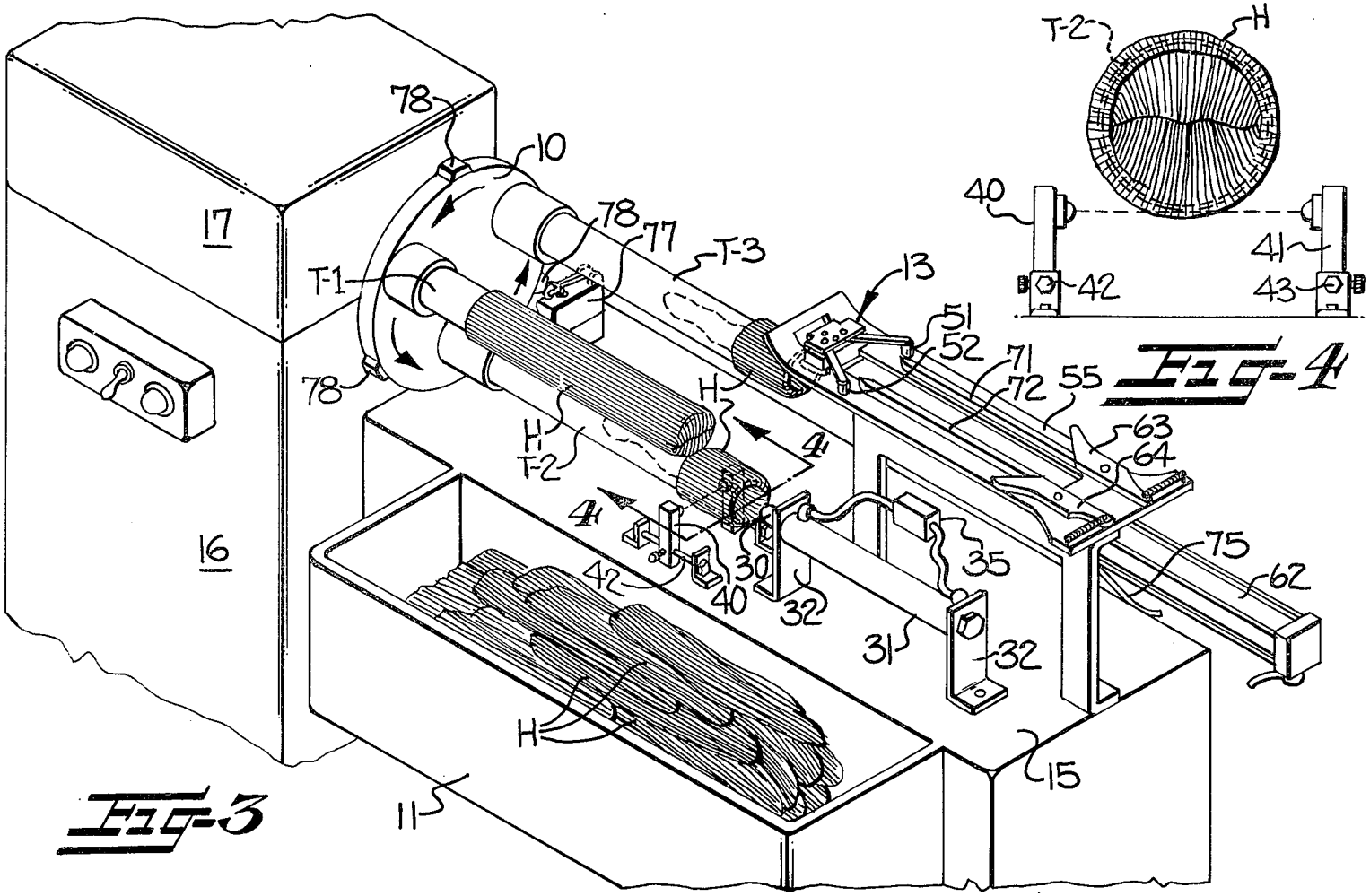
FIG. 3 is a fragmentary isometric view of the cuff forming apparatus.
FIG. 4 is an enlarged fragmentary view looking in the direction of the arrows 4—4 in FIG. 3.

The tubular member T-1, with the hosiery article H drawn over the outer surface thereof, is then moved downwardly to the folding station, the position occupied by the tubular member T-2 in FIG. 3, where the toe end of the hosiery article is moved inwardly of the tubular member, leaving the cuffed portion on the outside of and overlying and encircling a portion of the tubular member adjacent the open free end and the portion of the hosiery article positioned on the inside of the tubular member, as illustrated on the tubular member T-2 in FIG. 3. The means for forming the folded cuff at the folding station will be presently described.

The tubular member then is moved upwardly by the turret 10 to the stripping station, the position occupied by the tubular member T-3 in FIG. 3, where gripper means, broadly indicated at 13, is supported for reciprocating movement adjacent the open free end of the tubular member. Operator means is provided for moving the gripper means 13 inwardly to grip the outer end of the hosiery article with the cuff on the outside of the tubular member and for then moving the gripper means 13 outwardly to withdraw the cuffed hosiery article from the tubular member, in a manner to be presently described in detail.

In the particular apparatus illustrated, a table or main frame 15 is provided to support the apparatus at a convenient height above the floor, not shown. A drive support housing 16 is suitably connected to the main frame 15 and is provided with a removable cover 17. A drive motor 18 (FIGS. 1 and 2) is supported beneath the cover 17 and is drivingly connected to a gear reduction and clutch unit 19 provided with an output shaft and drive sprocket 20. The sprocket 20 is drivingly connected to a sprocket 21 by a drive chain 22. The sprocket 21 is fixed on a drive shaft 23 suitably supported in bearings 24 and having the turret 10 fixed to one end thereof.

Plunger means 30 is provided at the folding station and includes a free end aligned with and adapted to pass into the open free end of the tubular member when moved to the turning station, as illustrated by the tubular member T-2. Means is provided for supporting the plunger means 30 for reciprocating movement a predetermined distance into and out of the open free end of the tubular member so that the free end of the plunger means 30 engages and moves the closed toe end of the hosiery article inwardly of the tubular member. The plunger means 30 is illustrated as an enlarged element with a rounded smooth forward free end which is reciprocated into the tubular member, pushing the toe end of the hosiery article inwardly, and leaving a cuff portion on the outside of and overlying and encircling a portion of the tubular member adjacent the open free end and the portion of the hosiery article positioned on the inside of the tubular member, as illustrated on the tubular member T-2 in FIG. 3.

The means supporting the plunger means 30 for reciprocating movement includes a pneumatic cylinder 31 suitably supported at opposite ends on the upper ends of brackets 32 fixed at their lower ends on the table 15 and supporting the cylinder 31 in alignment with the tubular member when positioned at the folding station. A piston rod 33 is supported for sliding movement in the cylinder 31 and control means, in the form of a control valve 35 (FIG. 3) is provided for selectively directing pneumatic pressure to opposite ends of the cylinder 31 to thereby reciprocate the piston rod 33 and the plunger means 30 inwardly and outwardly relative to the open free end of the tubular member T-2. The plunger means 30 is moved inwardly and outwardly each time a successive tubular member is moved into alignment with the folding station.

Adjustment means is operatively associated with the plunger means 30 and the piston rod 33 for varying the length of the inward stroke of the plunger means 30 to thereby vary the length of the turned cuff on the hosiery article. In the present instance, the adjustment means is illustrated in the form of a pair of electric eye devices 40, 41, best illustrated in FIG. 4. As the plunger means 30 is moved inwardly, the free end of the hosiery article on the outer surface of the tubular member T-2 moves outwardly and when the free end of the hosiery article passes between the electric eye devices 40, 41, contact is completed between the two electric eye members to operate the control valve 35 and reverse the movement of the plunger means 30. The electric eye devices 40, 41 are supported for longitudinal adjustment along respective support rods 42, 43 so that the electric eye devices 40, 41 may be adjusted longitudinally to vary the length of the turned or folded cuff on the hosiery article.

After the folded cuff is formed on the hosiery article, the tubular member is moved to the stripping station, the position occupied by the tubular member T-3 in FIG. 3. The gripper means 13 is then automatically operated to move inwardly and grip the cuffed end of the hosiery article and to then move outwardly to remove and withdraw the cuffed hosiery article from the tubular member. The gripper means 13 includes a pair of stripper arms 45, 46 (FIGS. 5–7) having forward free ends which are covered by resilient hosiery gripping pads and normally urged toward each other by a tension spring 47 connected at opposite ends to the stripper arms 45, 46. The stripper arms 45, 46 are pivotally supported by screws 48, 49 beneath a plate member 50 and are provided with respective operator cam rollers 51, 52 supported for rotation at their rear free ends. The plate 50 is fixed on a dovetail slide bracket 53 (FIG. 7) which is supported for sliding movement along opposite sides of a longitudinal slot 54 provided in a guide plate 55.

Figure 2:
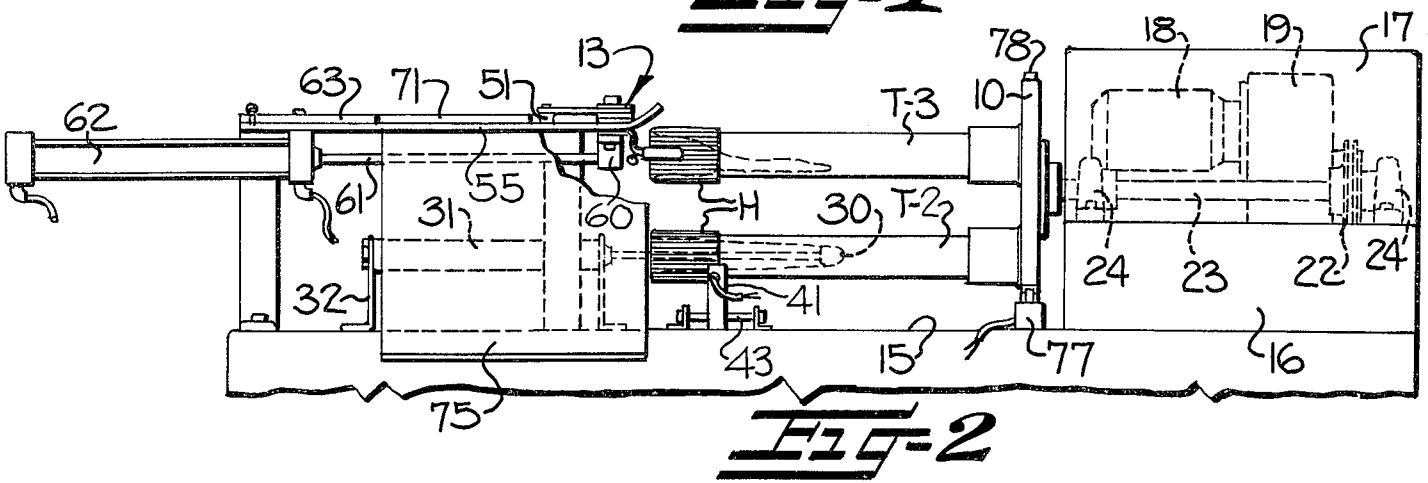
FIG. 2 is a side elevational view of the present apparatus shown in FIG. 1.

Operator means is provided for moving the gripper means 13 inwardly and outwardly and includes a bracket 60 (FIGS. 2 and 7) which is fixed to and extends downwardly from the dovetail slide block 53 and has the forward end of a piston rod 61 fixed thereto (FIG. 2). The piston rod is supported for sliding movement in a pneumatic cylinder 62 which is supported on the lower portion of the guide plate 55. The cylinder 62 is provided at opposite ends with control supply lines connected to the operating control valve 35 for selectively directing pneumatic pressure to opposite ends of the cylinder 62 to reciprocate the piston rod 61 back and forth and thereby slide the dovetail block 53 back and forth along the slot 54 in the guide plate 55.

Figure 5:
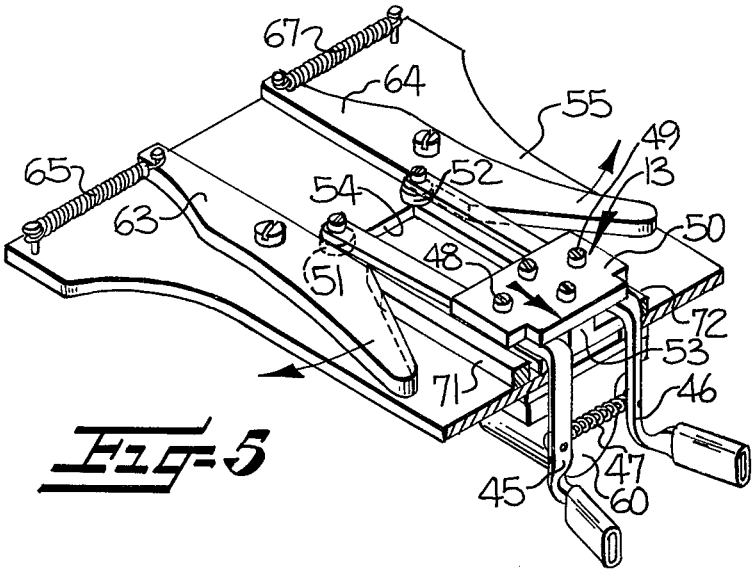
FIG. 5 is a fragmentary isometric view of the gripper means located at the stripping station, looking in the direction of the arrow 5 in FIG. 1 and with the gripper means in the outermost position and positioned to release the hosiery article.

When a cuffed sock is to be removed from the tubular member T-3, the gripper means 13 is moved forwardly, to the position shown in FIGS. 1-3 and 6, 7, to grip the cuff portion of the hosiery article. The gripper means 13 is then moved outwardly or rearwardly to the position shown in FIG. 5 and the forward ends of the stripper arms 45, 46 are separated to release the cuffed sock after it is removed and withdrawn from the tubular member. When the gripper means 13 is moved to the rearward position, as illustrated in FIG. 5, the operator cam rollers 51, 52 are moved inwardly toward each other by a pair of respective pivoted cam arms 63, 64 having their rear free ends normally urged away from each other by respective tension springs 65, 67. The inner end portions of the pivoted cam arms 63, 64 are resiliently urged upwardly toward each other and into engagement with the tapered rear ends of respective control cam tracks 71, 72.

Figure 6:
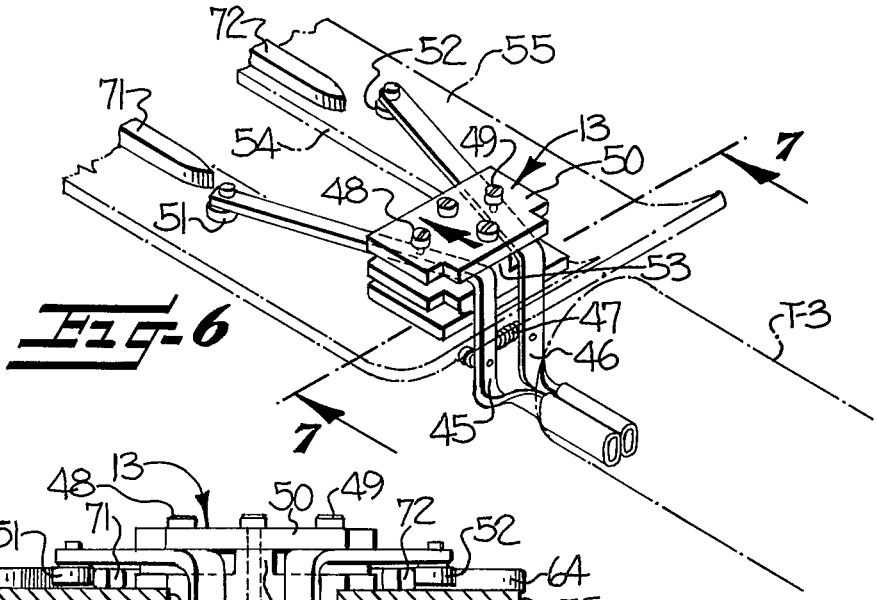
FIG. 6 is a view similar to FIG. 5 but looking in the direction of the arrow 6 in FIG. 1 and showing the gripper means in the forward position and positioned to grip the cuffed sock in preparation for removal from the tubular member.
Figure 7:
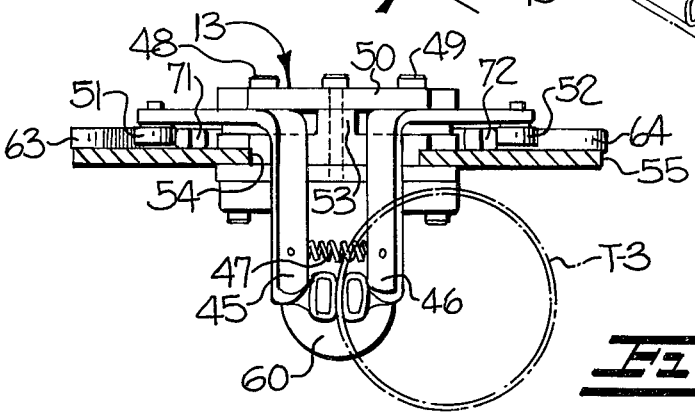
FIG. 7 is a vertical sectional view taken substantially along the line 7—7 in FIG. 6.

As the gripper means 13 is moved forwardly or inwardly by the cylinder 62, the stripper arms 45, 46 are maintained in the open position shown in FIG. 5 because the cam rollers 51, 52 engage the inner surfaces of the cam tracks 71, 72. When the gripper means 13 is moved to the forward position, when the forward end of the stripper arm 46 inside of the tubular member and with the forward end of the stripper arm 45 on the outside of the tubular member T-3, the cam rollers 51, 52 are moved forwardly of the forward ends of the cam tracks 71, 72 so that the tension spring 74 pulls the stripper arms 45, 46 together at their forward ends to grip the cuffed sock therebetween, as illustrated in FIGS. 6 and 7.

The cylinder 62 then moves the gripper means 13 rearwardly with the cam rollers 51, 52 engaging and traveling along the outer surfaces of the cam tracks 71, 72 so that the cuffed sock is stripped from the tubular member 73 and carried rearwardly by the stripper arms 45, 46 until the cam rollers 51, 52 engage the cam surfaces at the forward ends of the cam arms 63, 64. The cam rollers 51, 52 are then moved inwardly toward each other, as shown in FIG. 5, to thereby open the forward ends of the stripper arms 45, 46 to release the cuffed end of the hosiery article. The released hosiery article falls onto a slide plate 75 (FIGS. 1 and 2) which extends downwardly beneath the guide plate 55. The released hosiery article slides down and is directed into a suitable collection receptacle, not shown, by the guide plate 75.

Operation of the plunger means 30 at the turning station and operation of the gripper means 13 at the stripping station is automatically controlled by a switch 77 which is operated by suitable cams 78 mounted on the outer surface of the turret 10. The apparatus may be provided with a time switch for rotating the turret 10 at a predetermined step-by-step rate, or the operator may initiate each step of rotation of the turret, as by a suitable foot switch or the like, not shown.

OPERATION OF THE APPARATUS

With the apparatus in the position shown in FIG. 3, the operator removes a hosiery article H from the container 11 and draws the open free end of the hosiery article over the open free end of the tubular member T-1 until the closed end of the hosiery article covers the open free end of the tubular member, as illustrated in FIG. 3. A step of one-third of a rotation of the turret 10 then takes place so that the tubular member T-1 is moved to the turning or folding station (the position occupied by the tubular member T-2 in FIG. 3). The switch 77 is then actuated by one of the cams 78 to initiate operation of the plunger means 30 so that the plunger means 30 is automatically moved inwardly the desired distance until reversed by the electric eye devices 40, 41. Thus, the correct length of folded cuff is formed and remains on the outside of and overlying and encircling a portion of the tubular member adjacent the open free end and the portion of the hosiery article positioned on the inside of the tubular member, as illustrated in dotted lines. While the cuff is being formed on the hosiery article at the folding station, the operator is drawing another hosiery article onto the tubular member at the loading station.

The turret 10 then moves another step in rotation so that the cuffed hosiery article and the tubular member are successively moved to the stripping station (the position occupied by the tubular member T-3 in FIG. 3). Rotation of the turret 10 to this position causes the switch 77 to initiate operation of the gripper means 13 so that the gripper means 13 is moved from the outermost position shown in FIG. 5 to the innermost position shown in FIG. 6. Operation of the cylinder 62 and the piston rod 61 causes the stripper arms 45, 46 to move inwardly to grip the cuffed hosiery article in the manner illustrated in FIG. 6. The gripper means 13 is then moved rearwardly or outwardly by the cylinder 62 and the piston rod 61 and the inner ends of the stripper arms 45, 46 are separated, as illustrated in FIG. 5 so that the hosiery article which has been withdrawn from the tubular member falls onto the slide plate 75 and into a suitable container or receptacle, not shown.

Thus, the only manual step required of the operator is to successively draw a hosiery article over each tubular member as it is moved to the loading station. The subsequent forming of the cuff on the hosiery article automatically takes place at the folding station and then the cuffed hosiery article is automatically removed from the tubular member when it moves to the stripping station. The apparatus of the present invention thus provides means for rapidly and accurately forming cuffs on hosiery articles and for removing the cuffed hosiery articles from the apparatus without disturbing the position of the folded cuff on the hosiery article.

While the operation of the apparatus has been described in connection with the successive cuffing and stripping of a particular sock at the respective cuffing stripping stations, it is to be understood that the cuffing and stripping operations take place at the same time. Thus, while a sock with the cuff turned is being stripped from one of the tubular members, the cuff is being formed on another sock.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. An apparatus for forming a folded cuff on a hosiery article having an open end and a closed toe end, said apparatus comprising (a) a tubular member including an open free end over which the open end of the hosiery article is adapted to be drawn so that the closed toe end of the hosiery article covers said open free end of said tubular member, (b) plunger means including a free end aligned with and adapted to pass into said open free end of said tubular member, (c) means supporting said plunger means for reciprocating movement a predetermined distance into and out of said open free end of said tubular member so that said free end of said plunger means engages and moves the closed toe end of the hosiery article inwardly of said tubular member when reciprocated into said tubular member, leaving a cuff portion on the outside of and overlying and encircling a portion of said tubular member adjacent said open free end and the portion of the hosiery article positioned on the inside of said tubular member, and (d) gripper means supported for reciprocating movement parallel to said tubular member and adjacent said open free end of said tubular member, and (e) operator means for moving said gripper means inwardly to said open free end of said tubular member to grip the hosiery article with the cuff on the outside of said tubular member and the reaminder of the hosiery article on the inside and for then moving said gripper means outwardly and away from said open free end of said tubular member and in a direction parallel to said tubular member to withdraw the cuffed hosiery article from said tubular member.

2. An apparatus according to claim 1 including a turret supported for step-by-step rotation adjacent said plunger and said gripper means, a plurality of said tubular members supported at one end in equally spaced positions on said turret with said open free ends being adapted to pass in alignment with said plunger and said gripper means, and means for rotating said turrent in a step-by-step manner to successively align said open free ends of said tubular members with said plunger and said gripper means.

3. An apparatus according to claim 1 wherein said means supporting said plunger means for reciprocation comprises a pneumatic cylinder and a piston rod supported for sliding movement in said cylinder, said piston rod including a free end aligned with said open free end of said tubular member, and including control means for directing pneumatic pressure to selected sides of said cylinder to thereby reciprocate said piston rod inwardly and outwardly relative to said open free end of said tubular member.

4. An apparatus according to claim 3 including adjustment means operatively associated with the inward movement of said piston rod for varying the length of the inward stroke of said piston rod to thereby vary the length of the turned cuff on the hosiery article.

5. An apparatus according to claim 1 wherein said gripper means comprises a pair of stripper arms having free inner and outer ends, means pivotally supporting said stripper arms intermediate their ends, means supporting said stripper arms for movement toward and away from said open free end of said tubular member, and cam means operatively associated with said outer free ends of said stripper arms for maintaining said inner free ends of said stripper arms toward each other during movement of said gripper means away from said tubular member and for maintaining said free inner ends of said stripper arms separated from each other during movement of said gripper means toward said tubular member.

6. An apparatus according to claim 1 wherein said operator means comprises a pneumatic cylinder and a piston rod supported for sliding movement in said cylinder, said piston rod including a forward end operatively connected to said gripper means for reciprocating said gripper means inwardly and outwardly relative to said free open end of said tubular member.

* * * * *